US011662075B2

(12) United States Patent
Lee

(10) Patent No.: US 11,662,075 B2
(45) Date of Patent: May 30, 2023

(54) LAMP FOR VEHICLE AND VEHICLE INCLUDING THE SAME

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/811,018

(22) Filed: Jul. 6, 2022

(65) Prior Publication Data

US 2023/0067882 A1 Mar. 2, 2023

(30) Foreign Application Priority Data

Aug. 24, 2021 (KR) ..... 10-2021-0111718

(51) Int. Cl.

| | |
|---|---|
| ***F21S 41/27*** | (2018.01) |
| ***F21S 41/143*** | (2018.01) |
| ***F21S 41/275*** | (2018.01) |
| ***F21S 41/32*** | (2018.01) |
| ***F21W 102/155*** | (2018.01) |
| ***F21W 102/135*** | (2018.01) |

(52) U.S. Cl.

CPC ..... *F21S 41/27* (2018.01); *F21S 41/143* (2018.01); *F21S 41/275* (2018.01); *F21S 41/322* (2018.01); *F21W 2102/135* (2018.01); *F21W 2102/155* (2018.01)

(58) Field of Classification Search

CPC ..... F21W 2102/135; F21W 2102/155; F21S 41/143; F21S 41/27; F21S 41/275; F21S 41/322; F21S 41/285

See application file for complete search history.

(56) References Cited

U.S. PATENT DOCUMENTS

| | | | | |
|---|---|---|---|---|
| 2017/0130923 | A1* | 5/2017 | Nishimura | F21S 41/265 |
| 2019/0017675 | A1* | 1/2019 | Suwa | F21S 41/24 |
| 2019/0323672 | A1* | 10/2019 | Nishimura | F21S 41/322 |
| 2022/0018511 | A1* | 1/2022 | Sugihara | F21S 41/275 |

FOREIGN PATENT DOCUMENTS

| | | | | |
|---|---|---|---|---|
| WO | WO-2017185118 | A1 * | 11/2017 | F21S 41/143 |

* cited by examiner

*Primary Examiner* — Erin Kryukova
(74) *Attorney, Agent, or Firm* — DLA Piper LLP (US)

(57) ABSTRACT

A lamp for a vehicle, the lamp including: a light source unit and a lens structure that projects the light emitted from the light source unit to form a certain beam pattern. The lens structure includes: a body part; an entrance part that allows the light emitted from the light source unit to be incident to the body part; and an exit part that allows the light incident to the body part to be emitted forward. The body part includes a recessed portion configured to block the light which is emitted from the light source unit and arrives at the recessed portion. The entrance part includes an upper region and a lower region which are provided in an upper portion and a lower portion, respectively, with respect to an optical axis of the exit part, and curvature of the upper region is different from curvature of the lower region.

16 Claims, 8 Drawing Sheets

| Category | Comparative example | Exemplary embodiment |
| --- | --- | --- |
| Image |  |  |
| Total light amount | 119lm | 129lm |
| Maximum luminous intensity | 2870cd | 3150cd |

(a) (b)

LAMP FOR VEHICLE AND VEHICLE INCLUDING THE SAME

CROSS-REFERENCE TO RELATED APPLICATION(S)

This application claims priority from and the benefit of Korean Patent Application No. 10-2021-0111718, filed on Aug. 24, 2021, which is hereby incorporated by reference for all purposes as if set forth herein.

TECHNICAL FIELD

Exemplary embodiments relate to a lamp for a vehicle and a vehicle including the lamp and, more particularly, to a lamp for a vehicle, which minimizes an optical loss to enhance an optical efficiency, and a vehicle including the lamp.

BACKGROUND

In general, a vehicle is provided with various types of lamps having: a lighting function for easily identifying an object located around the vehicle during night driving; and a signal function for informing other vehicles or road users of the driving state of the vehicle. For example, a low beam lamp, a high beam lamp, a daytime running light (DRL) lamp, and the like are mounted to the front of the vehicle. Among these lamps, the low beam lamp forms a light distribution pattern that has a cut-off line shape in an upper portion thereof.

Meanwhile, in order for the low beam lamp to form the cut-off line as described above, a shield is disposed at a position, where a focus of an exit-side lens is formed, thereby forming the cut-off line. Here, the light is diffused at the position where the focus of the exit-side lens is formed.

FIG. 1 illustrates a lamp for a vehicle according to the related art, which uses an optical system according to the related art to form a low beam pattern.

Referring to FIG. 1, a lamp 1 for a vehicle according to the related art includes: a light source unit 10 including a light source 11 and a collimator 12 by which light emitted from the light source 11 is made to be parallel light; and a lens structure 20 that projects the light emitted from the light source unit 10 to form a certain beam pattern. The lens structure 20 includes: a body part 21; an entrance part 22 which is formed on a surface of the body part 21, to which the light is incident, and allows the light emitted from the light source unit 10 to be incident to the body part 21; and an exit part 23 which is formed on a surface of the body part 21, from which the light is emitted, and allows the light incident from the body part 21 to be emitted forward. The body part 21 includes a recessed portion 24 which is recessed toward a central region, in the up-down direction, of the body part 21. Here, the recessed portion 24 may serve as a shield that blocks the light, which is emitted from the light source unit 10 and arrives at the recessed portion 24, and forms a cut-off line.

However, in the lamp 1 for a vehicle that uses an optical system according to the related art, the light incident via a lower portion of the entrance part 22 arrives at the recessed portion 24 and is then totally reflected therefrom as illustrated in FIG. 1. Thus, an optical path changes, and the light is emitted to a non-light distribution region, resulting in an optical loss.

SUMMARY

Exemplary embodiments of the present invention provide a lamp for a vehicle, in which a curvature, in the vertical direction, of a lower region of an entrance part is greater than a curvature, in the vertical direction, of an upper region thereof. Therefore, the lamp may minimize an optical loss and enhance an optical efficiency.

A first exemplary embodiment of the present invention provides a lamp for a vehicle, the lamp including: a light source unit configured to emit light; and a lens structure which is located in front of the light source unit and projects the light emitted from the light source unit to form a certain beam pattern, wherein the lens structure includes: a body part; an entrance part which is formed on a surface of the body part, to which the light is incident, and allows the light emitted from the light source unit to be incident to the body part; and an exit part which is formed on a surface of the body part, from which the light is emitted, and allows the light incident to the body part to be emitted forward, wherein the body part includes a recessed portion which is recessed toward a central region, in the up-down direction, of the body part, and the recessed portion is configured to block the light which is emitted from the light source unit and arrives at the recessed portion, wherein the entrance part includes an upper region and a lower region which are provided in an upper portion and a lower portion, respectively, with respect to an optical axis of the exit part, and curvature of the upper region is different from curvature of the lower region.

The curvature of the lower region may be greater than the curvature of the upper region.

The curvature of the lower region in the vertical direction may be greater than the curvature of the upper region in the vertical direction.

The lower region may be configured such that the light emitted from the light source unit is collected in the vicinity of a focus formed by the exit part.

The entrance part and the exit part may be provided as an anamorphic lens.

A focus of the lower region in the vertical direction may correspond to a focus of the exit part in the vertical direction.

A focal length of the exit part may be less than a focal length of the lower region.

A focal length of the exit part may be equal to a focal length of the lower region.

The light source unit may include: a light source configured to generate the light; and a collimator which is provided in a direction from the light source toward the lens structure, and allows the light emitted from the light source to be converted into parallel light, which is parallel to an optical axis of the lens structure, and then incident to the lens structure.

The light source, the collimator, and the lens structure may be arranged in the optical axis of the lens structure.

The body part, the entrance part, and the exit part may be integrally formed.

The recessed portion may have a shape that is recessed from a lower surface of the body part toward the central region.

The recessed portion may include: a blocking layer configured to block a portion of the light incident to the body part; and a cut-off edge formed at an upper end of the blocking layer and configured to form a cut-off line of a low beam pattern.

The cut-off edge may be provided at a position corresponding to a focus, in the vertical direction, of the exit part.

A size of the entrance part in the up-down direction may be greater than a size of the exit part in the up-down direction or equal to the size of the exit part in the up-down direction.

A second exemplary embodiment of the present invention provides a vehicle including a lamp for a vehicle, wherein the lamp includes: a light source unit configured to emit light; and a lens structure which is located in front of the light source unit and projects the light emitted from the light source unit to form a certain beam pattern, wherein the lens structure includes: a body part; an entrance part which is formed on a surface of the body part, to which the light is incident, and allows the light emitted from the light source unit to be incident to the body part; and an exit part which is formed on a surface of the body part, from which the light is emitted, and allows the light incident to the body part to be emitted forward, wherein the body part includes a recessed portion which is recessed toward a central region, in the up-down direction, of the body part, and the recessed portion is configured to block the light which is emitted from the light source unit and arrives at the recessed portion, wherein the entrance part includes an upper region and a lower region which are provided in an upper portion and a lower portion, respectively, with respect to an optical axis of the exit part, and curvature of the upper region is different from curvature of the lower region.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, exemplary embodiments of the present disclosure will be described in detail according to the accompanying drawings.

First, exemplary embodiments described below are suitable for understanding the technical characteristics of a lamp for a vehicle according to the present disclosure. However, the present disclosure is not limited to the exemplary embodiments described below, or the technical features of the present disclosure are not limited by the described exemplary embodiments, and various modifications are possible within the technical scope of the present disclosure.

Figure 1:
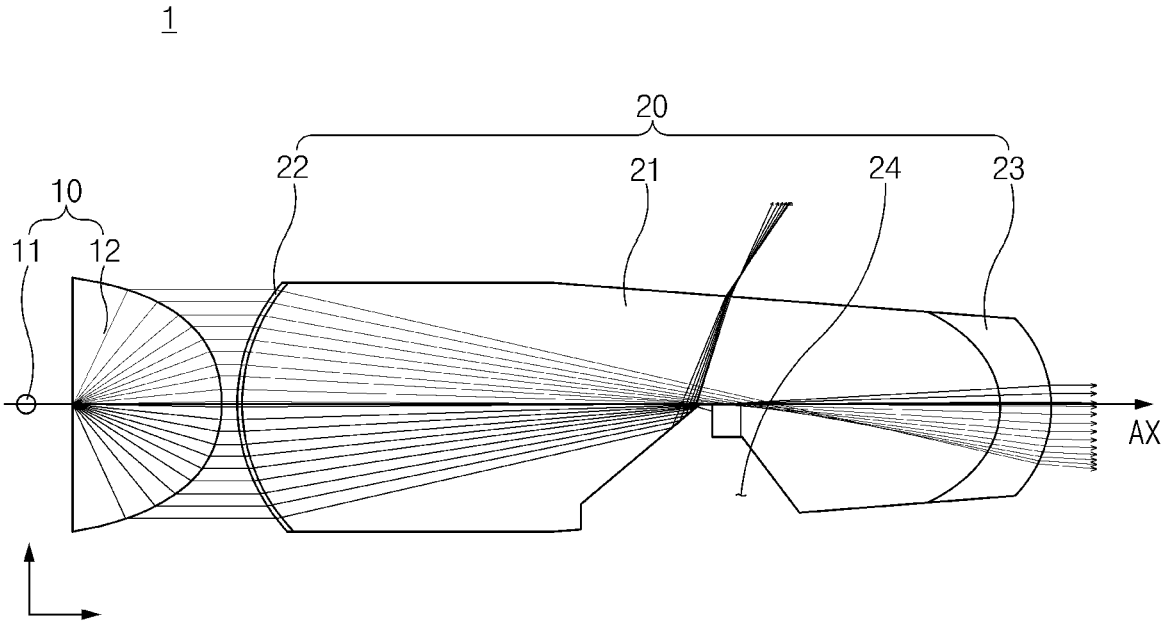
FIG. 1 is a view when a lamp for a vehicle according to the related art is viewed from the side to explain a path of light generated in a light source.
Figure 2:
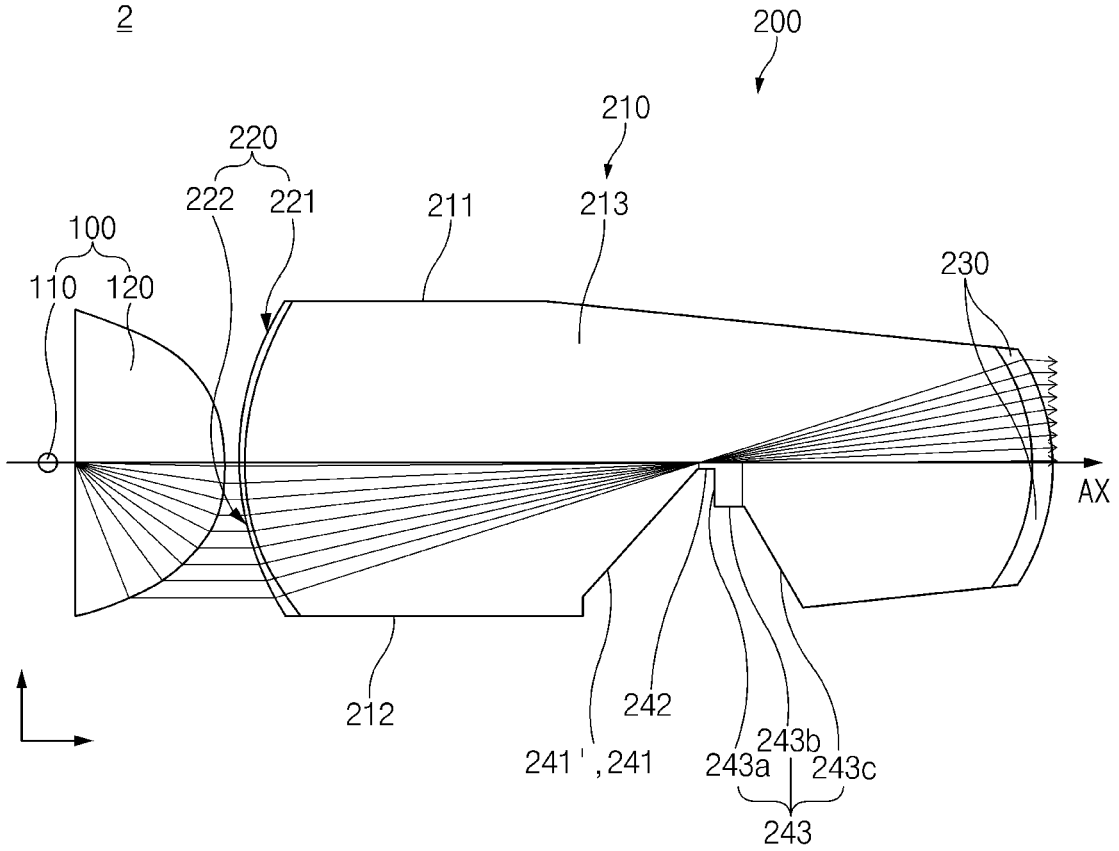
FIG. 2 is a side view of a lamp for a vehicle according to an exemplary embodiment of the present disclosure to explain a path of light generated in a light source.
Figure 3:
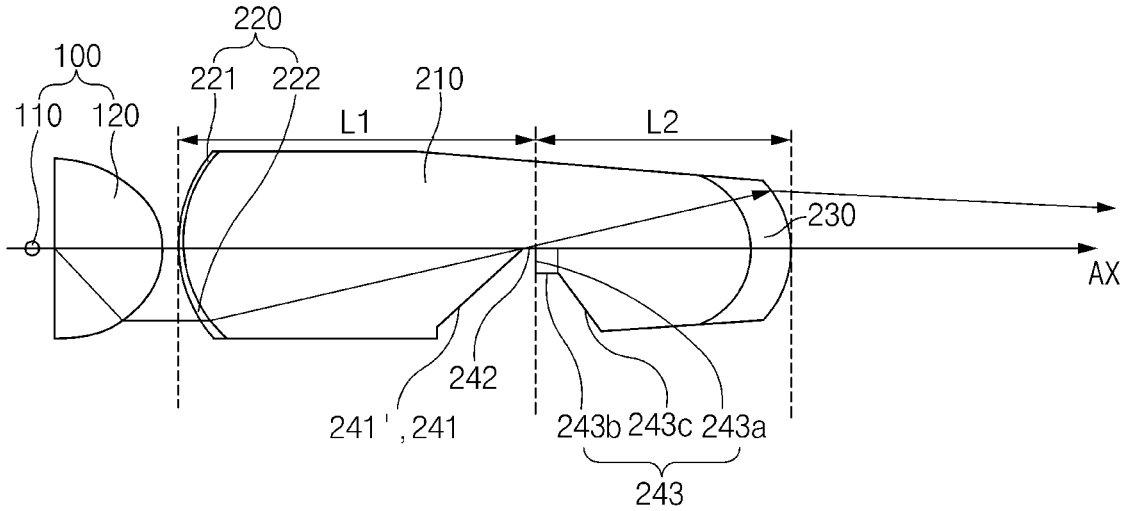
FIG. 3 is a side view of a lamp for a vehicle according to an exemplary embodiment of the present disclosure to explain a path of light according to focal lengths of an exit part and a lower region of an entrance part.
Figure 4:
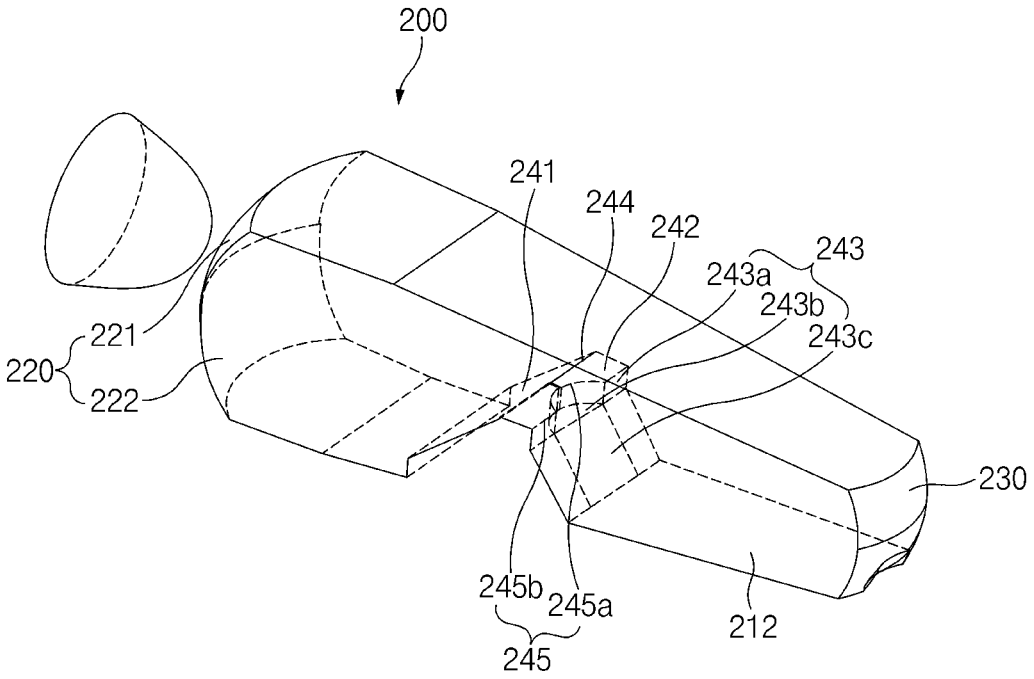
FIG. 4 is a perspective view of a lamp for a vehicle according to the present disclosure to explain a shape of a recessed portion.
Figure 5:
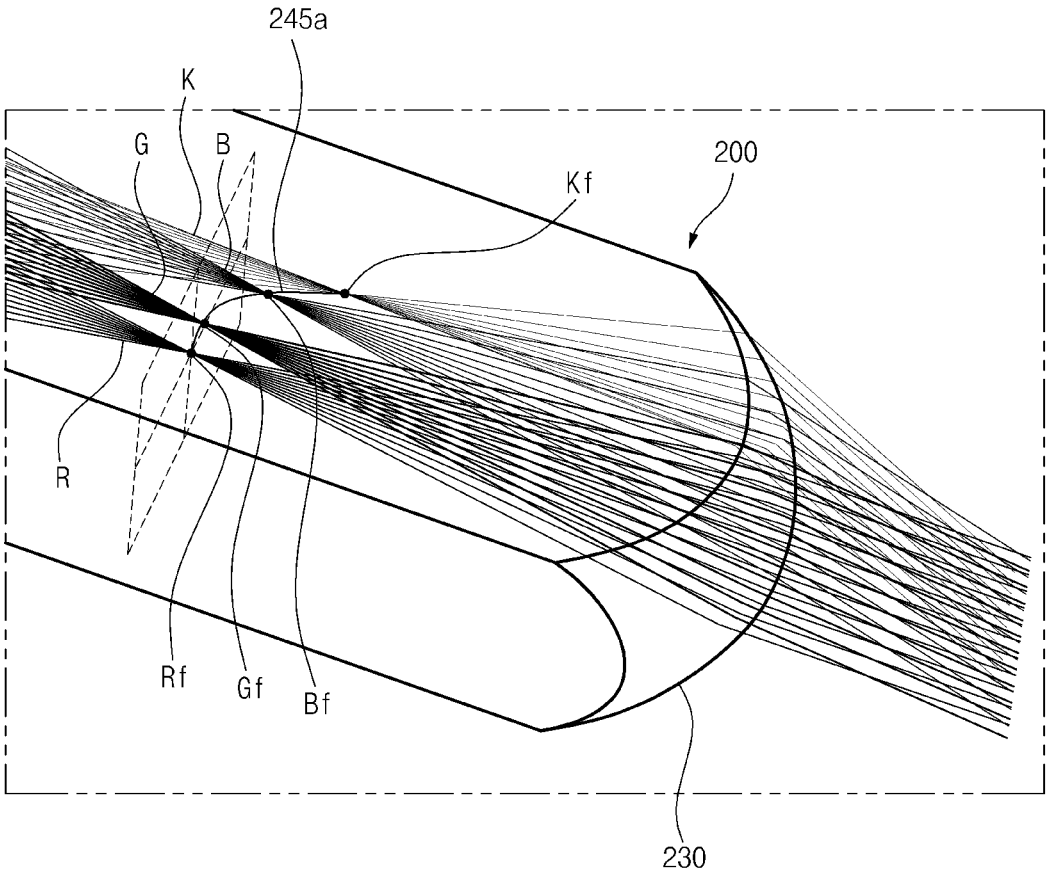
FIG. 5 is a view illustrating a state in which horizontal off-axis light passes through the inside of a lens structure according to an exemplary embodiment of the present disclosure.
Figure 6:
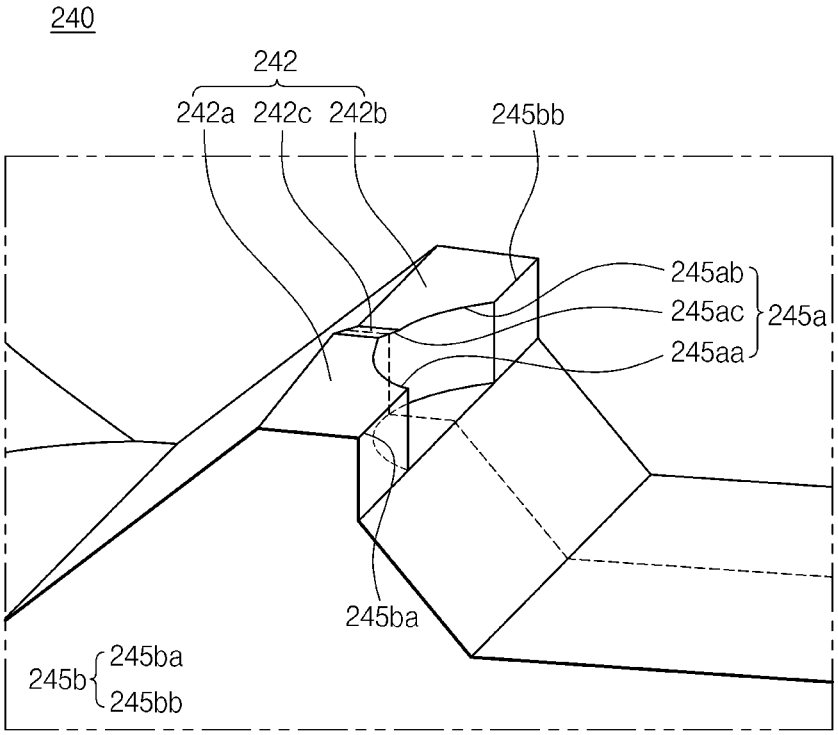
FIG. 6 is an enlarged view illustrating a recessed portion of a lens structure according to an exemplary embodiment of the present disclosure.
Figure 7:
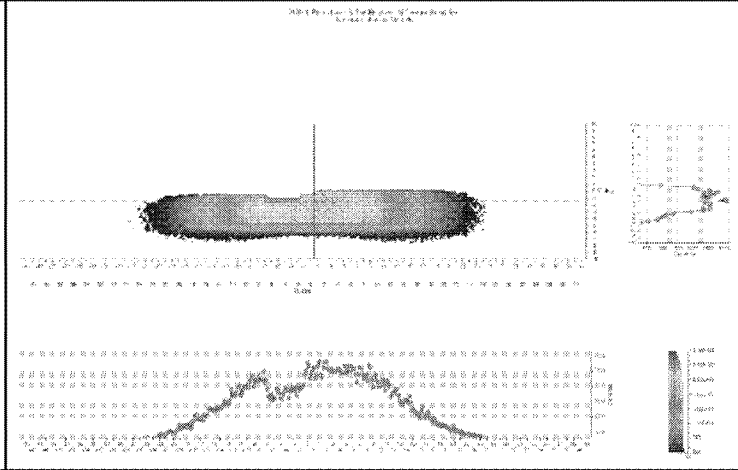
FIG. 7 is a table for comparing the total light amounts and maximum luminous intensities of light distribution patterns formed by a lamp for a vehicle according to the related art and a lamp for a vehicle according to an exemplary embodiment of the present disclosure.
Figure 7:
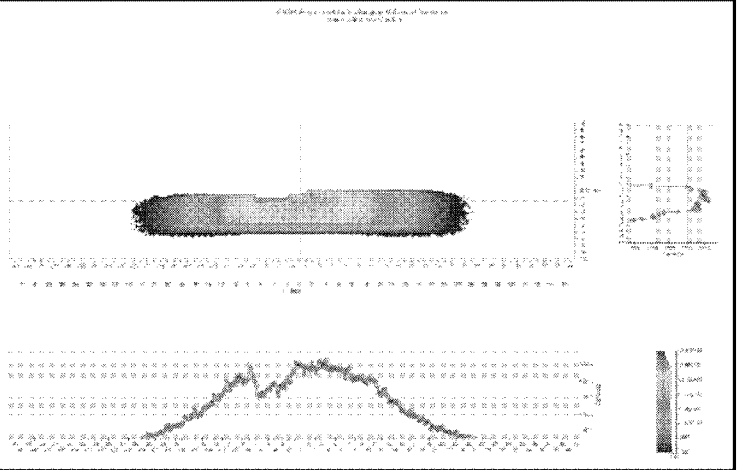
Figure 8:
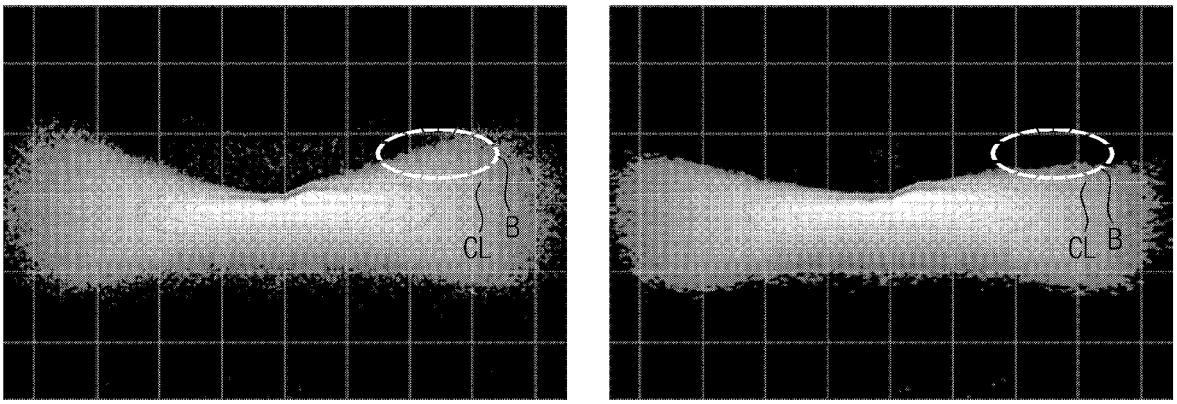
FIG. 8 is a view for comparing the shapes of low beam light distribution patterns formed by a lamp for a vehicle according to the related art and a lamp for a vehicle according to an exemplary embodiment of the present disclosure.

FIG. 1 is a view when a lamp for a vehicle according to the related art is viewed from the side to explain a path of light generated in a light source. FIG. 2 is a side view of a lamp for a vehicle according to an exemplary embodiment of the present disclosure to explain a path of light generated in a light source. FIG. 3 is a side view of a lamp for a vehicle according to an exemplary embodiment of the present disclosure to explain a path of light according to focal lengths of an exit part and a lower region of an entrance part. FIG. 4 is a perspective view of a lamp for a vehicle according to the present disclosure to explain a shape of a recessed portion. FIG. 5 is a view illustrating a state in which horizontal off-axis light passes through the inside of a lens structure according to an exemplary embodiment of the present disclosure. FIG. 6 is an enlarged view illustrating a recessed portion of a lens structure according to an exemplary embodiment of the present disclosure. Also, FIG. 7 is a table for comparing the total light amounts and maximum luminous intensities of light distribution patterns formed by a lamp for a vehicle according to the related art and a lamp for a vehicle according to an exemplary embodiment of the present disclosure. FIG. 8 is a view for comparing the shapes of low beam light distribution patterns formed by a lamp for a vehicle according to the related art and a lamp for a vehicle according to an exemplary embodiment of the present disclosure.

A lamp 2 for a vehicle according to an exemplary embodiment of the present disclosure includes a light source unit 100 and a lens structure 200.

Herein, the light source unit 100 is configured to generate and emit light. Here, the light source unit 100 may use various elements and devices capable of emitting light. The light source unit 100 may include a light source 110 that generates light, and the light source 110 may be, for example, a light emitting diode (hereinafter, referred to as an LED). However, the light source 110 is not limited to the LED.

For example, the light source unit 100 may emit parallel light forward toward the lens structure 200. Specifically, the light source unit 100 may further include a collimator 120. The collimator 120 is provided in a direction from the light source 110 toward the lens structure 200, and may allow the light emitted from the light source 110 to be converted into parallel light, which is parallel to an optical axis AX of the lens structure 200, and then incident to the lens structure 200. Also, the light source 110, the collimator 120, and the lens structure 200 may be arranged in the optical axis AX of the lens structure 200 and, more specifically, in the optical axis AX of an exit part 230.

Meanwhile, the lens structure 200 is located in front of the light source unit 100 and projects the light emitted from the light source unit 100 to form a certain beam pattern. Hereinafter, for convenience of description, a direction in which the light is emitted, that is, a direction from the light source 110 toward the lens structure 200 is referred to as the front direction. The opposite direction from the front direction is referred to as the rear direction.

More specifically, the lens structure 200 includes a body part 210, an entrance part 220, and an exit part 230 as illustrated in FIG. 2.

Here, the body part 210 constitutes a body of the lens structure 200 and may be made of a material through which the incident light passes.

Specifically, the body part 210 may include: an upper surface 211 for connecting the entrance part 220 to the exit part 230; a lower surface 212 facing the upper surface 211; and a side surface 213 located between the upper surface 211 and the lower surface 212.

Here, the upper surface 211, the lower surface 212, and the side surface 213 of the body part 210 may have various shapes depending on sizes and the like of the entrance part 220 and the exit part 230 which will be described later. For example, the upper surface 211 may be inclined downward in the forward direction. Also, the lower surface 212 may be formed horizontally or inclined downward in the forward direction but less inclined than the upper surface 211, or may be inclined upward in the forward direction.

Meanwhile, the body part 210 may include a recessed portion 240 which is recessed toward a central region, in the up-down direction, of the body part 210. Here, the recessed portion 240 may be provided to block the light which is emitted from the light source unit 100 and arrives at the recessed portion 240.

Specifically, the recessed portion 240 may have a shape that is recessed from the lower surface 212 of the body part 210 toward the central region. Here, the recessed portion 240 may be located on a path through which the light incident to the body part 210 travels. Also, the recessed portion 240 may be provided to block a portion of the light.

Specifically, according to the lamp 2 for a vehicle according to an exemplary embodiment of the present disclosure, a focus of the exit part 230 may be positioned inside the body part 210 of the lens structure 200, and the recessed portion 240 may be formed at the central region of the body part 210, and a portion of the light may be blocked at a position corresponding to the focus of the exit part 230.

More specifically, a portion of the light is blocked by the recessed portion 240 according to the present disclosure, and thus the light emitted from the exit part 230 may form a cut-off line of a low beam pattern. That is, according to the present disclosure, the recessed portion 240 is formed by modifying the shape of the body part 210 to form the cut-off line of the low beam pattern. Thus, the cut-off line may be formed without a separate shield member. Here, the detailed shape of the recessed portion 240 will be described later.

Meanwhile, the entrance part 220 is formed on a surface of the body part 210, to which the light is incident, and allows the light emitted from the light source unit 100 to be incident to the body part 210. That is, the entrance part 220 may be formed on the surface that faces the rear of the body part 210, and may be configured such that the light emitted from the light source unit 100 is collected inside the body part 210.

Also, the entrance part 220 may be formed as various lenses. For example, the entrance part 220 may be formed as a convex lens, an aspherical surface lens, or an anamorphic lens that is recessed toward the light source unit 100.

Also, the entrance part 220 may have various sizes. Specifically, the exit part 230, which will be described later, is a part exposed to the outside, and thus the size thereof is limited by exterior design or regulations for a lamp. However, the entrance part 220 is located inside a vehicle body and not exposed to the outside, and thus the size limitation is relatively small. Thus, the size of the entrance part 220 may be equal to that of the exit part 230 or relatively greater than that of the exit part 230. For example, the size of the entrance part 220 in the up-down direction may be greater than the size of the exit part 230 in the up-down direction, or may be equal to the size of the exit part 230 in the up-down direction. Accordingly, the light emitted from the light source unit 100 may be collected as much as possible in the entrance part 220, and thus optical loss may be minimized.

Meanwhile, in the lamp for a vehicle according to the related art, a portion of the light incident from the entrance part 22 may be blocked by the recessed portion 24 as described above. Specifically, as illustrated in FIG. 1, among light incident to the entrance part 22, light, which is incident to a lower region of the entrance part 22 with respect to the optical axis AX of the exit part 23, is totally reflected by the recessed portion 24. Thus, this light does not contribute to forming a beam pattern because an optical path thereof is changed. Accordingly, optical loss may occur, and optical performance of the lamp for a vehicle may deteriorate.

In order to solve the above limitation, the present disclosure provides the lamp for a vehicle, in which the entrance part 220 is divided into an upper region 221 and a lower region 222 with respect to an optical axis AX of the exit part 230. The light incident through the lower region 222 is collected in the vicinity of the focus of the exit part 230, and thus optical loss may be minimized.

Specifically, the entrance part 220 according to the present disclosure may include, as illustrate in FIG. 2, an upper region 221 provided above the optical axis AX of the exit part 230 and a lower region 222 provided below the optical axis AX of the exit part 230.

Here, the upper region 221 is a region provided in an upper portion of the entrance part 220 with respect to the optical axis AX of the exit part 230 and may have various configurations.

Specifically, according to a type and function of the lamp for a vehicle, the upper region 221 may collect the light, which is incident via the upper region 221, in the vicinity of the focus of the exit part 230, or may diffuse the light in the vicinity of the focus of the exit part 230. To this end, the curvature of the upper region 221 may be adjusted according to the purpose such as collection or diffusion of the light.

For example, when the upper region 221 is provided to collect the light in the vicinity of the focus of the exit part 230, the focus of the upper region 221 may correspond to the focus of the exit part 230. Here, when the upper region 221 and the exit part 230 are anamorphic lenses, the focus of the upper region 221 in the vertical direction may correspond to the focus of the exit part 230 in the vertical direction. Also, when the upper region 221 is provided to diffuse the light in the vicinity of the focus of the exit part 230, the focus of the upper region 221 may not correspond to the focus of the exit part 230. Meanwhile, in the specification, a feature in which 'two focuses correspond to each other' may be interpreted as including not only a case where the two focuses are completely identical to each other but also a case where two focuses are formed sufficiently close to each other to exhibit substantially the same performance as the case where the two focuses are identical to each other.

Meanwhile, the lower region 222 is a region provided in a lower portion of the entrance part 220 with respect to the optical axis AX of the exit part 230 and may have various configurations.

Specifically, the lower region 222 may collect the light, which is incident via the lower region 222, in the vicinity of the focus of the exit part 230. More specifically, in order to minimize a rate of the light which has been incident via the lower region 222 but does not contribute to a beam pattern because totally reflected by the recessed portion 240, the light incident from the light source unit 100 may be collected in the vicinity of the focus formed by the exit part 230. To this end, the focus of the lower region 222 may correspond to the focus of the exit part 230. Here, when the lower region 222 and the exit part 230 are anamorphic lenses, the focus of the lower region 222 in the vertical direction may correspond to the focus of the exit part 230 in the vertical direction.

Meanwhile, the lower region 222 may be configured such that the lower region 222 has large curvature to prevent the light incident parallel to the lower region 222 in the horizontal direction from being blocked by the recessed portion 240. Therefore, it is possible to increase refractive index of the light that is incident to the lower region 222. Accordingly, the lower region 222 and the upper region 221 may have different curvature. Specifically, the curvature of the lower region 222 may be greater than the curvature of the upper region 221. More specifically, the curvature of the lower region 222 in the vertical direction may be greater than the curvature of the upper region 221 in the vertical direction.

However, when both the upper region 221 and the lower region 222 have the focuses corresponding to the focus of the exit part 230 to collect the light in the vicinity of the exit part 230, the upper region 221 and the lower region 222 may have the same curvature.

Meanwhile, the exit part 230 is formed on a surface of the body part 210, from which the light is emitted, and allows the light incident to the body part 210 to be emitted forward. Specifically, the exit part 230 may be formed on the surface that faces the front of the body part 210.

Specifically, the exit part 230 may be formed as various lenses. For example, the exit part 230 may have a shape recessed forward, and may be provided in the form of an aspherical surface lens, an anamorphic lens, or a Fresnel lens that enables reduction in thickness for a degree of freedom in design.

Also, the exit part 230 may be integrally formed with the body part 210 and the entrance part 220. Here, the focus of the exit part 230 may be positioned inside the body part 210 of the lens structure 200. Specifically, the focus of the exit part 230 may be positioned at a location corresponding to a cut-off edge 242 of the recessed portion 240 which will be described later.

Also, in the present disclosure, a focal length L2 of the exit part 230 may be less than a focal length L1 of the lower region 222 of the entrance part 220 or equal to the focal length L1 of the lower region 222. For example, as illustrated in FIG. 3, the focal length L2 of the exit part 230 is less than the focal length L1 of the lower region 222 of the entrance part 220, and thus the light, which is incident from the lower region 222 and collected in the vicinity of the focus of the exit part 230, may arrive at the exit part 230. Accordingly, the light incident from the lower region 222 is emitted toward a light distribution region, and thus optical loss may be prevented.

Meanwhile, the recessed portion 240, which serves as a shield of a low beam lamp in the lamp 2 for a vehicle having the above features according to the present disclosure, may have various shapes.

For example, the recessed portion 240 may include: a blocking layer 241' for blocking a portion of the light incident to the body part 210; and a cut-off edge 242 formed at an upper end of the blocking layer 241' and forming a cut-off line of a low beam pattern.

Specifically, the blocking layer 241' may be formed on a first surface 241 adjacent to the entrance part 220. Also, the blocking layer 241' may extend obliquely downward in a direction toward the light source unit 100 as it goes downward from the cut-off edge 242, and may block the light which is incident to the lower end of the cut-off edge 242. Meanwhile, in the drawing, the reference numerals 241 and 241' are illustrated as indicating the same positions. However, the blocking layer 241' is a component formed additionally on the surface of the first surface 241, and thus it should be noted that the first surface 241 and the blocking layer 241' are distinct concepts.

For example, the blocking layer 241' may be formed on the first surface 241 by deposition, and the blocking layer 241' may be made of various materials capable of blocking light. In one example, the blocking layer 241' may be formed on the first surface 241 by depositing an aluminum material to reflect the light. However, the material and formation method of the blocking layer 241' are not limited to those described above, and various materials and methods capable of blocking the light may be employed.

The cut-off edge 242 may be formed at the upper end of the blocking layer 241' and provided to form the cut-off line of the low beam pattern.

Specifically, the cut-off edge 242 may be connected to the first surface 241 at a first connection portion 244 as illustrated in FIG. 4. Here, the first connection portion 244 may represent a line that connects the first surface 241 to the cut-off edge 242.

Also, the cut-off edge 242 may be provided at a position corresponding to the focus of the exit part 230. In one example, the cut-off edge 242 may be provided at a position corresponding to the focus of the exit part 230. More specifically, the cut-off edge 242 may be provided to connect the first surface 241 to a second surface 243. That is, the front end of the cut-off edge 242 may be connected to the second surface 243, and the rear end of the cut-off edge 242 may be connected to the first surface 241. Here, the shape of the cut-off edge 242 is not limited, and may be formed diversely according to design specifications for forming a low beam pattern.

For example, as illustrated in FIG. 6, the cut-off edge 242 may include: a lower cut-off edge 242*b* formed on one side of the left-right direction with respect to a direction from the entrance part 220 toward the exit part 230; an upper cut-off edge 242*a* formed on the other side of the left-right direction and provided above the lower cut-off edge 242*b*; and a stepped cut-off edge 242*c* for connecting the lower cut-off edge 242*b* to the upper cut-off edge 242*a*. Here, the one side may be the left side when viewed in a direction from the entrance part 220 toward the exit part 230, and the other side may be the right side when viewed in the direction from the entrance part 220 toward the exit part 230. However, the one side and the other side described above may be interchanged.

Also, the upper cut-off edge 242*a* and the lower cut-off edge 242*b* are parallel to the optical axis AX of the exit part 230, and the stepped cut-off edge 242*c* are formed obliquely. Thus, the upper cut-off edge 242*a* and the lower cut-off edge 242*b* may be connected to each other with a stepped portion formed therebetween.

Also, as described above, the recessed portion 240 may include the second surface 243 that is connected from the cut-off edge 242 at a second connection portion 245 and extends. Here, the second surface 243 may be a portion for connecting the cut-off edge 242 to the lower surface 212 that is adjacent to the exit part 230 among the lower surface 212 provided in the lens structure 200, and the second connection portion 245 may represent a line that connects the cut-off edge 242 to the second surface 243.

Meanwhile, when parallel light having an angle in the horizontal direction (hereinafter, referred to as 'horizontal off-axis light') is incident to the lens structure 200, the positions of the focuses may be formed differently for each color of light and become inconsistent with the cut-off edge 242 having a line shape that exists on one plane. As a result, light blur due to aberration may occur. Such light blur may cause glare to drivers in oncoming vehicles and pedestrians, thereby obstructing their views, which may lead to traffic accidents.

Thus, the second connection portion 245 according to the present disclosure may include a curved connection portion 245*a* and a linear connection portion 245*b* formed on both sides of the curved connection portion 245*a*. Specifically, the second connection portion 245 is configured such that the curved connection portion 245*a* is formed at the center in the left-right direction when the lens structure 200 is viewed from above. The linear connection portion 245*b* is formed on both sides of the curved connection portion 245*a* and may be symmetric in the left-right direction with respect to the center of the lens structure 200. Hereinafter, the curved connection portion 245*a* will be described in more detail.

For example, horizontal off-axis light, which may be incident to the lens structure 200, will be described first in detail with reference to FIG. 5. For example, in the horizontal off-axis light, the red light R may be horizontal to the optical axis, green light G may form an angle of about 5 degrees with the optical axis, blue light B may form an angle of about 10 degrees with the optical axis, and black light K may form an angle of about 20 degrees with the optical axis. Thus, the horizontal off-axis light has various angles in the horizontal direction according to colors of the light, and the positions of focuses Rf, Gf, Bf, and Kf for colors may also be formed differently. That is, with regard to the horizontal off-axis light, a focus is not formed on a single plane or straight line, but focuses are formed along a curved surface or curved line.

Thus, the second connection portion 245 according to the present disclosure may include the curved connection portion 245*a* having certain curvature as illustrated in FIG. 4. Through this, a low beam pattern is formed by changing the angle of light that may cause light blur, and it is possible not only to increase optical efficiency but also to prevent glare for an oncoming vehicle. Here, the certain curvature may represent curvature having a shape which corresponds to a virtual line that connects the plurality of focuses Rf, Gf, Bf, and Kf formed for colors of the horizontal off-axis light as illustrated in FIG. 5. The curved connection portion 245*a* may be preferably formed along the positions of the plurality of focuses Rf, Gf, Bf, and Kf.

Also, the curved connection portion 245*a* may have a shape recessed in a direction from the exit part 230 toward the entrance part 220. Here, the recessed shape may represent a portion of a circular or elliptical shape.

Meanwhile, the second surface 243 may include a vertical surface 243*a*, a horizontal surface 243*b*, and an inclined surface 243*c*. When described in detail, the vertical surface 243*a* is connected to the cut-off edge 242 at the second connection portion 245 described above and vertically extends downward from the second connection portion 245, and thus may have the vertical direction that corresponds to the shape of the second connection portion 245. Here, when the second connection portion 245 includes the curved connection portion 245*a* and the linear connection portion 245*b* and the curved connection portion 245*a* has a shape recessed in the direction from the exit part 230 toward the entrance part 220 as illustrated in FIG. 4, the vertical surface 243*a* of the second surface 243 may also have a surface that is recessed rearward so as to correspond to the recessed shape of the curved connection portion 245*a*.

Also, the horizontal surface 243*b* may be a surface that is connected to the vertical surface 243*a* and extends horizontally in the direction from the entrance part 220 toward the exit part 230, and the inclined surface 243*c* may be connected to the vertical surface 243*a* and the horizontal surface 243*b* and inclined downward in the direction from the entrance part 220 toward the exit part 230.

Meanwhile, when the cut-off edge 242 having the stepped shape as described above is provided, the first connection portion 244 for connecting the first surface 241 to the cut-off edge 242 and the second connection portion 245 for connecting the cut-off edge 242 to the second surface 243 may also have stepped shapes. Hereinafter, the stepped shape of the second connection portion 245 will be described in detail.

As described above, the second connection portion 245 may include the curved connection portion 245*a* and the linear connection portions 245*b*. Thus, the stepped shape may be formed at the curved connection portion 245*a* that is formed at the center, in the left-right direction, of the second connection portion 245. The curved connection portion 245*a* may include: an upper curved connection portion 245*aa* formed in a section in which the upper cut-off edge 242*a* of the recessed portion 240 meets the second surface 243; and a lower curved connection portion 245*ab* formed in a section in which the lower cut-off edge 242*b* meets the second surface 243. Also, the curved connection portion 245*a* may further include a stepped curved connection portion 245*ac* formed in a section in which the stepped cut-off edge 242*c* of the recessed portion 240 meets the second surface 243.

In addition, the linear connection portion 245*b* may include: an upper linear connection portion 245*ba* formed in a section in which the upper cut-off edge 242*a* of the recessed portion 240 meets the second surface 243; and a lower linear connection portion 245*bb* formed in a section in which the lower cut-off edge 242*b* meets the second surface 243.

Hereinafter, an effect of enhancing optical efficiency of the lamp for a vehicle according to the present disclosure will be described with reference to FIG. 7. FIG. 7 shows the total light amount (lm) and maximum luminous intensity (cd) of a light distribution pattern formed by the lamp 1 for a vehicle according to the related art (hereinafter, referred to as a 'comparative example') and the total light amount (lm) and maximum luminous intensity (cd) of a light distribution pattern formed by the lamp 2 for a vehicle according to the present disclosure (hereinafter, referred to as an 'exemplary embodiment').

First, when examining the low beam light distribution pattern formed in the comparative example, it can be seen that the total light amount (lm) and maximum luminous intensity (cd) are 119 lm and 2870 cd, respectively. On the other hand, when examining the low beam light distribution pattern formed in the exemplary embodiment, it is found that the total light amount (lm) and maximum luminous intensity (cd) are 129 lm and 3150 cd, respectively. That is, in the exemplary embodiment compared to the comparative example, it is found that the total light amount (lm) increases by about 8%, and the maximum luminous intensity (cd) increases by about 9%. As described above, it is found that the lamp for a vehicle according to the exemplary embodiment of the present disclosure may have the increased total light amount (lm) and maximum luminous intensity (cd) and thus enhance optical efficiency.

Hereinafter, a light distribution pattern of a lamp for a vehicle according to the presence or absence of the curved connection portion 245*a* will be described with reference to FIG. 8. Part (a) of FIG. 8 illustrates a low beam light distribution pattern formed by a lamp for a vehicle in which the curved connection portion 245*a* is not included (hereinafter, referred to as a 'comparative example'), and Part (b) of FIG. 8 illustrates a low beam light distribution pattern formed by a lamp for a vehicle according to the present disclosure in which the curved connection portion 245*a* is included (hereinafter, referred to as an 'exemplary embodiment according to the present disclosure').

First, when examining the light distribution pattern formed by the comparative example of Part (a) of FIG. 8, it can be seen that light distribution patterns are formed above the left and right sides of a cut-off line CL. The light distribution patterns formed above the cut-off line CL may cause glare to drivers in oncoming vehicles or pedestrians, thereby obstructing their views. On the other hand, with respect to the light distribution patterns formed by the exemplary embodiment of the present disclosure in Part (b) of FIG. 8, it can be seen that light distribution patterns are not formed above the left and right sides of a cut-off line CL. In particular, it can be seen that a light distribution pattern is not formed in a region B above the right side of the cut-off line CL. Therefore, the light distribution pattern formed according to the exemplary embodiment of the present disclosure may sufficiently secure the front view without obstructing the views of the drivers in oncoming vehicles or pedestrians, thereby significantly reducing the risk of accidents.

Meanwhile, the present disclosure may provide a vehicle that includes a lamp for a vehicle, the lamp including: a light source unit 100 emitting light; and a lens structure 200 which is located in front of the light source unit 100 and projects the light emitted from the light source unit 100 to form a certain beam pattern. The lens structure 200 includes: a body part 210; an entrance part 220 which is formed on a surface of the body part 210, to which the light is incident, and allows the light emitted from the light source unit 100 to be incident to the body part 210; and an exit part 230 which is formed on a surface of the body part 210, from which the light is emitted, and allows the light incident to the body part 210 to be emitted forward. The body part 210 includes a recessed portion 240 which is recessed toward a central region, in the up-down direction, of the body part 210, and the recessed portion 240 blocks the light, which is emitted from the light source unit 100 and arrives at the recessed portion 240. The entrance part 220 includes an upper region 221 and a lower region 222 which are provided in an upper portion and a lower portion, respectively, with respect to an optical axis of the exit part 230, and curvature of the upper region 221 is different from curvature of the lower region 222.

Meanwhile, the contents described above with respect to the lamp according to the present disclosure may also be applied, in the same manner, to the vehicle according to the present disclosure.

In the lamp for the vehicle according to the exemplary embodiment of the present disclosure, the entrance part is made of the upper and lower regions having different curvature, and the curvature of the lower region in the vertical direction is greater than the curvature of the upper region in the vertical direction. Therefore, the optical efficiency may be enhanced by minimizing the loss of light incident to the lower region.

Also, in the lamp for the vehicle according to the exemplary embodiment of the present disclosure, the focal length of the exit part is equal to the focal length of the lower region of the entrance part or less than the focal length of the lower region of the entrance part. Therefore, the optical loss may be minimized by preventing the incident light from being trapped inside the lens structure or the optical path from being changed to the non-light distribution region.

Although the specific exemplary embodiments of the present disclosure have been described, the concept and scope of the present disclosure are not limited to theses specific exemplary embodiments. Various changes and modifications may be made by one skilled in the art to which the present disclosure pertains without departing from the subject matters of the present disclosure as hereinafter claimed.

What is claimed is:

1. A lamp for a vehicle, the lamp comprising:

a light source unit configured to emit light; and a lens structure located in front of the light source unit and that projects the light emitted from the light source unit to form a certain beam pattern, wherein the lens structure comprises:

a body part;

an entrance part formed on a surface of the body part and which allows the light emitted from the light source unit to be incident to the body part; and an exit part formed on a surface of the body part and which allows the light incident to the body part to be emitted forward, wherein the body part comprises a recessed portion that is recessed toward a central region, in an up-down direction, of the body part, and the recessed portion is configured to block the light emitted from the light source unit, wherein the entrance part comprises an upper region and a lower region provided in an upper portion and a lower portion, respectively, with respect to an optical axis of the exit part, and a curvature of the upper region is different from a curvature of the lower region.

2. The lamp of claim 1, wherein the curvature of the lower region is greater than the curvature of the upper region.

3. The lamp of claim 2, wherein the curvature of the lower region in a vertical direction is greater than the curvature of the upper region in the vertical direction.

4. The lamp of claim 1, wherein the lower region is configured such that the light emitted from the light source unit is collected in the vicinity of a focus formed by the exit part.

5. The lamp of claim 1, wherein the entrance part and the exit part are provided as an anamorphic lens.

6. The lamp of claim 5, wherein a focus of the lower region in the vertical direction corresponds to a focus of the exit part in the vertical direction.

7. The lamp of claim 1, wherein a focal length of the exit part is less than a focal length of the lower region.

8. The lamp of claim 1, wherein a focal length of the exit part is equal to a focal length of the lower region.

9. The lamp of claim 1, wherein the light source unit comprises:

a light source configured to generate the light; and a collimator provided in a direction from the light source toward the lens structure, and that allows the light emitted from the light source to be converted into light parallel to an optical axis of the lens structure, and then incident to the lens structure.

10. The lamp of claim 9, wherein the light source, collimator, and lens structure are arranged in the optical axis of the lens structure.

11. The lamp of claim 1, wherein the body part, entrance part, and exit part are integrally formed.

12. The lamp of claim 1, wherein the recessed portion has a shape that is recessed from a lower surface of the body part toward the central region.

13. The lamp of claim 12, wherein the recessed portion comprises:

a blocking layer configured to block a portion of the light incident to the body part; and a cut-off edge formed at an upper end of the blocking layer and configured to form a cut-off line of a low beam pattern.

14. The lamp of claim 13, wherein the cut-off edge is provided at a position corresponding to a focus, in the vertical direction, of the exit part.

15. The lamp of claim 1, wherein a size of the entrance part in the up-down direction is greater than or equal to a size of the exit part in the up-down direction.

16. A vehicle comprising a lamp for a vehicle, wherein the lamp comprises:

a light source unit configured to emit light; and a lens structure located in front of the light source unit and that projects the light emitted from the light source unit to form a certain beam pattern, wherein the lens structure comprises:

a body part;

an entrance part formed on a surface of the body part and which allows the light emitted from the light source unit to be incident to the body part; and an exit part formed on a surface of the body part and which allows the light incident to the body part to be emitted forward, wherein the body part comprises a recessed portion that is recessed toward a central region, in an up-down direction, of the body part, and the recessed portion is configured to block the light emitted from the light source unit, wherein the entrance part comprises an upper region and a lower region provided in an upper portion and a lower portion, respectively, with respect to an optical axis of the exit part, and a curvature of the upper region is different from a curvature of the lower region.

* * * * *